US007712837B2

(12) United States Patent
Ekornes

(10) Patent No.: US 7,712,837 B2
(45) Date of Patent: May 11, 2010

(54) PADDING FOR FURNITURE

(75) Inventor: Arve Ekornes, Ikornnes (NO)

(73) Assignee: Ekornes ASA, Ikornnes (NO)

( * ) Notice: Subject to any disclaimer, the term of this patent is extended or adjusted under 35 U.S.C. 154(b) by 0 days.

(21) Appl. No.: 12/092,124

(22) PCT Filed: Oct. 31, 2006

(86) PCT No.: PCT/NO2006/000389

§ 371 (c)(1),
(2), (4) Date: Jul. 2, 2008

(87) PCT Pub. No.: WO2007/053035

PCT Pub. Date: May 10, 2007

(65) Prior Publication Data

US 2008/0290716 A1 Nov. 27, 2008

(30) Foreign Application Priority Data

Oct. 31, 2005 (NO) ..... 20055064

(51) Int. Cl.
*A47C 7/20* (2006.01)

(52) U.S. Cl. ..... 297/452.53; 297/452.47; 297/452.57

(58) Field of Classification Search ..... 297/452.27, 297/452.47, 452.57, 452.52, 452.53
See application file for complete search history.

(56) References Cited

U.S. PATENT DOCUMENTS 3,161,436 A * 12/1964 Hood ..... 297/452.27
4,265,484 A * 5/1981 Stalter ..... 297/452.57
4,879,776 A 11/1989 Farley
5,564,144 A * 10/1996 Weingartner et al. ..... 297/452.27 X
5,816,661 A * 10/1998 Sakurai et al. ..... 297/452.47
6,755,475 B1 6/2004 Tiesler et al.

FOREIGN PATENT DOCUMENTS

| | | |
|---|---|---|
| DE | 296 21 190 U1 | 2/1997 |
| DE | 200 19 161 U1 | 1/2001 |
| EP | 0 908 123 B1 | 1/2004 |
| FR | 2 473 291 | 7/1981 |
| GB | 1 445 561 | 8/1976 |
| GB | 2 044 091 A | 10/1980 |
| RU | 5323 | 11/2008 |

* cited by examiner

*Primary Examiner*—Anthony D Barfield
(74) *Attorney, Agent, or Firm*—Schneck & Schneck; Thomas Schneck

(57) ABSTRACT

The present invention concerns a padding for a cushion (1), such as a cushion for a seat, comprising foam material (100), with modified resilience provided by recesses (101), in at least one section of the cushion, the size and/or density of the recesses being different in adjacent sections providing a varying softness or collapsibility in the foam material (100) in one surface direction of the cushion, wherein the recesses (101) may be non-transient and a frame (410) may be completely or partly embedded in the foam. The invention also concerns a seat cushion or furniture comprising such padding and the method for producing such padding.

15 Claims, 4 Drawing Sheets

PADDING FOR FURNITURE

The present invention concerns a novel padding, especially suitable for furniture, and a seat cushion comprising such padding, especially a seat cushion for chairs or sofas.

BACKGROUND OF THE INVENTION

In the padding of furniture, different types of foam are normally used, such as foam rubber, polyurethane, latex etc, in the outer layer bordering to the cover of the furniture which may be of textile, leather or a synthetic material. The padding of the seat of furniture, such as a seat in the chair, may for example lie over other types of spring systems, such as slats, spiral springs or rib springs, or the padding material may make out the entire suspension in itself.

It may be difficult to adapt the suspension of furniture to different users, and in such an adaptation must usually be performed as a consequence of the user's weight. A hard or soft suspension will be experienced differently in relation to how heavy the user is. However, it is difficult to adjust such suspension in an automated system without using spring material of different density and/or stiffness.

An accompanying problem concerns the structure of a seat in furniture, such as a chair or a sofa seat, wherein the padding normally should be harder towards the sides of the seat in order to provide support, and possibly softer towards the front edge in order to make it easy to sit down and get up, simultaneously as a flexible support is achieved when the user leans forward. In order to obtain such effects it has been common to provide different types of springs under the seat of the chair, or to build up the seat with different types of foam with different properties. However, it is difficult and expensive technically in production to perform such a build up, and several lines of production are necessary.

U.S. Pat. No. 6,755,475 discloses a cushion structure with several internal volumes created by inflatable containers. The containers provide free volumes in the mould during moulding and may be filled with foams of different property such as resilience, after the moulding of the cushion or at the same time, through pin holes. The technique is however complex and requires inflatable containers of varying sizes that will withstand hot liquid foam moulded around the containers. The precision of the size and position of the containers is also limited, and the combinations are limited to a minimum size.

DE 296 21 190 discloses a mattress comprising a foam material with channels running over the entire width of the mattress, the channels having an inverted T-shaped cross sectional shape. The channels may have different spacing and dimensions to provide varying resilience. However, variation in resilience will only be provided in the length direction of the mattress, and will not provide increased side support, such as needed in a seat.

From prior art, continuous holes in upper mattresses of foam or latex are known in order to provide ventilation of the mattress during use. GB 1 445 561 discloses a mattress of foam material with drilled cavities going through the mattress. The cavities are arranged in limited length sections with a varying density of holes per area to provide varying resilience over the length of the mattress. However, holes going through the foam product may lead to tearing the product during stress especially if the density of number of holes per area is high.

DE 200 19 161 discloses devices for mounding cavities into a foam element such as a mattress. The device comprises a stem connected to a main body with a larger dimension than the stem around which foam is moulded, the shape of the main body may be of different shapes. The device also comprises a cutting device for extracting the main body out of the cured foam after moulding. The cutting of the foam material after curing will however also degrade the product as it may give rise to rupture during use when subjected to stress.

Further, foam mattresses are known with even "wave top patterns" in order to increase the softness of mattresses in relation to the stiffness of the foam. However, no variation in the stiffness is provided by the padding in the different parts of the furniture where they are used.

Therefore, there is a need for a padding wherein the resilience of the padding varies locally, preferably with smooth transitions without straining the foam material causing ruptures. The padding should be produced in a simple, quick and cost effective manner, preferably integrated with modern elements for furniture.

SUMMARY OR THE INVENTION

The present invention thus concerns a padding for a cushion, such as a cushion for a seat, comprising foam material, with modified resilience provided by recesses, in at least one section of the cushion, the size and/or density of the recesses being different in adjacent sections providing a varying softness or collapsibility in the foam material in one surface direction of the cushion, wherein the recesses may be non-transient and a frame may be completely or partly embedded in the foam. The invention also concerns a seat cushion or furniture comprising such padding, a method for producing such padding and the use thereof.

The pattern of the recesses may be moulded into the padding for a seat cushion, or may possibly be drilled out after moulding. The properties in the padding may be regulated in that the size of the recesses may be adjusted in depth and diameter, as well as shape (cylindrical, square, hexagonal etc.). Further, the pattern may be adjusted in relation to how close the recesses are positioned in relation to each other, and these properties may be adjusted in smooth transitions providing new properties in the padding from what is earlier known.

The invention also concerns seat cushions for furniture comprising such padding.

OVERVIEW OF THE DRAWINGS

DETAILED DESCRIPTION

The present invention will now be described in more detail by the help of an example embodiment which is not meant to limit the scope of the invention, which is defined in the appended claims.

Figure 1A:
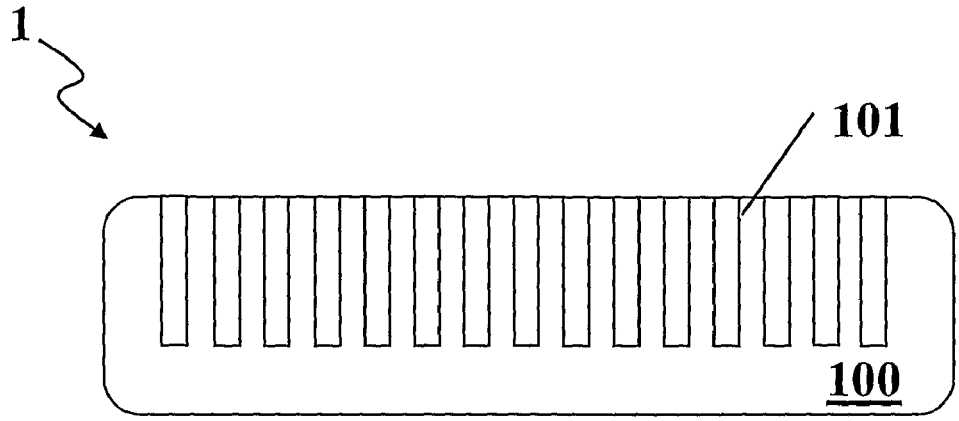
FIGS. 1A and 1B show padding according to the present invention, viewed in section and from above respectively.
Figure 1B:
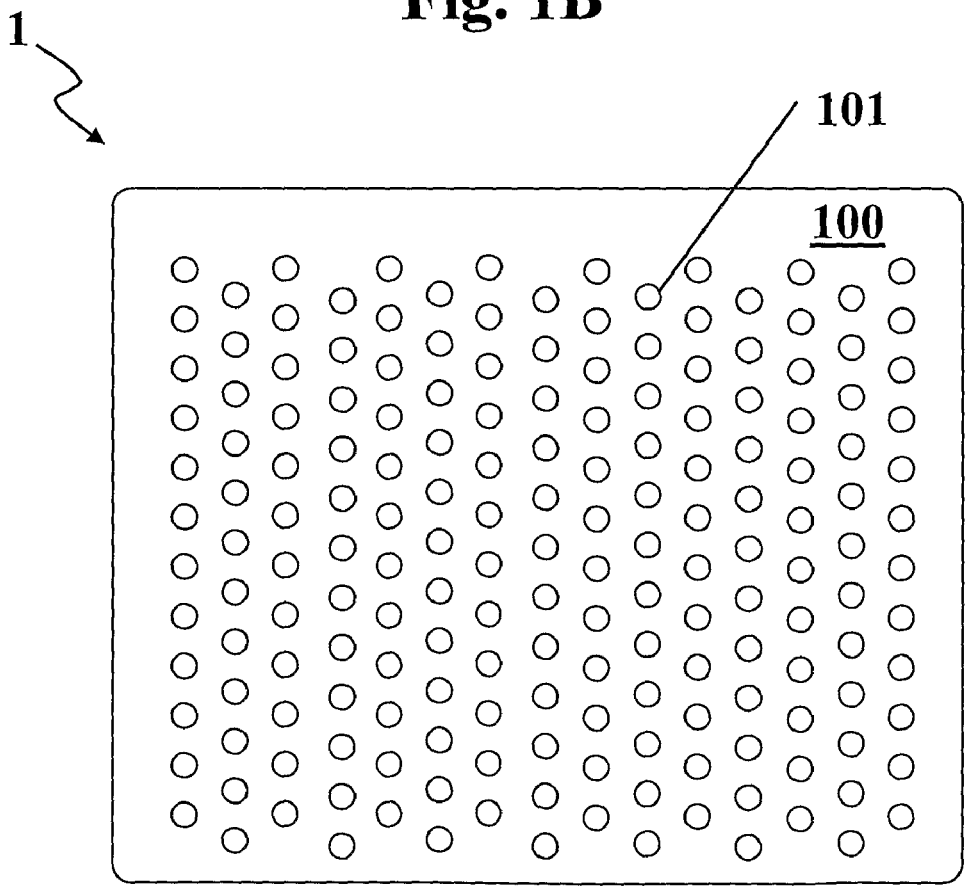

In FIGS. 1A and 1B a first embodiment of the invention is shown. The padding 1, which may be for a cushion for a chair or a sofa, consists of a foam material 100 and comprises recesses 101 with opening towards the top surface of the padding which stretches to a certain depth of the foam, which is shown in FIG. 1A as a section in the horizontal direction of the padding. Further, as may be seen in FIG. 1B, which is a view from above, the recesses 101 may be positioned with a certain distance in relation to each other, such as in a constant distance and cover most of the padding 1. The pattern may be somewhat offset toward one side edge of the padding, which for example may be the side edge which will be the front edge of the padding when placed in a furniture, such as a chair.

Figure 2A:
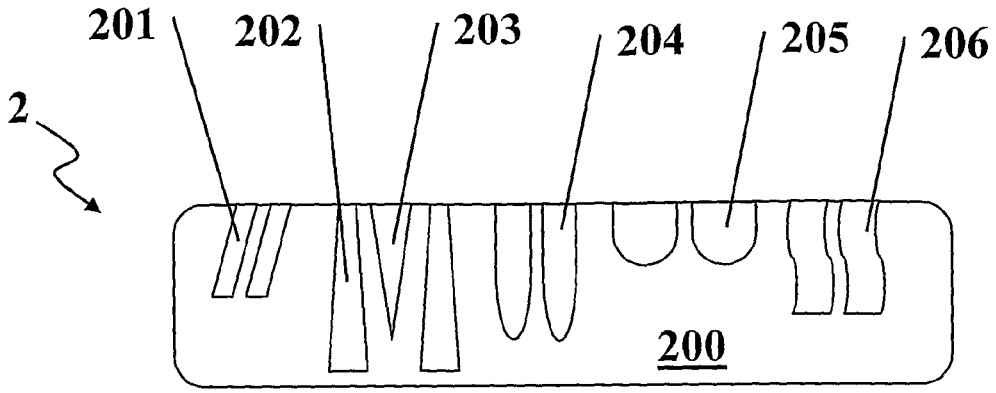
FIGS. 2A and 2B show alternative embodiments of the padding in FIGS. 1A and 1B.

The recesses 101 in the padding in FIG. 1 have a cylindrical vertical form with a constant depth which is easy to mould into the foam 100 during production. However, the recesses may have a variation of forms and depths as shown in another embodiment of the invention in FIG. 2A. The recesses may for example have a slanted position in relation to the surface of the padding 1, such as recesses 201, which will influence the sitting comfort/experience. The recesses 201 will for example collapse the foam 200 in a certain direction when subjected to load. Further, the recesses may have an increasing cross sectional circumference in relation to the depth, such as the recesses 202, or a decreasing circumference, such as the recesses 203, and the latter recesses may also be placed in combinations as shown in FIG. 2A in order to provide special characterizing resilient properties. For production concerns it may be an advantage for the recesses to have a quite even cross sectional circumference, or a decreasing cross sectional circumference toward the bottom of the recess, such as the recesses 204. This form eases the removal of the mould and reduced the risk of the recess tearing or that the moulding foam 200 is stuck on the mould. Preferably the mould is oiled or treated with an anti stick additive before moulding. Depending on the foam 200 used, the width of the cross sectional circumference may be small or large, such as the recesses 205. However, the size of the opening must be adjusted to the material of which the padding is covered so that the recesses are not visible on the surface of the cover. Alternatively, the recesses may have an uneven vertical cross sectional form, such as the recesses 206 which have an arched lamella form. Such a form may provide special flexible properties as it uses the foam to create the flexible structures.

Figure 2B:
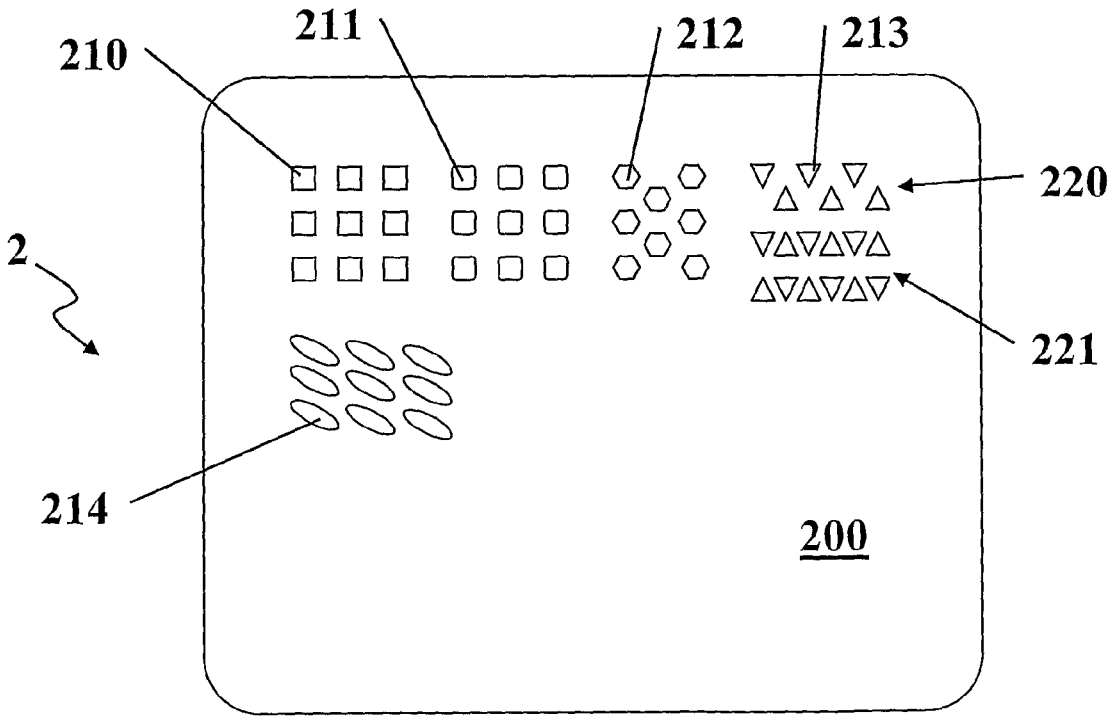

In addition to variable circumference the cross sectional form of the recesses may vary as shown in FIG. 2B. The form may be any form and in FIG. 2B examples are shown on embodiments such as square 201, rounded square 211, hexagonal 212, triangular 214 and oval 213. Further, the placement of the recesses in relation to each other in the horizontal plan may vary, amongst other depending on the form used, such as illustrated by the arrangements 220 and 221.

Figure 3A:
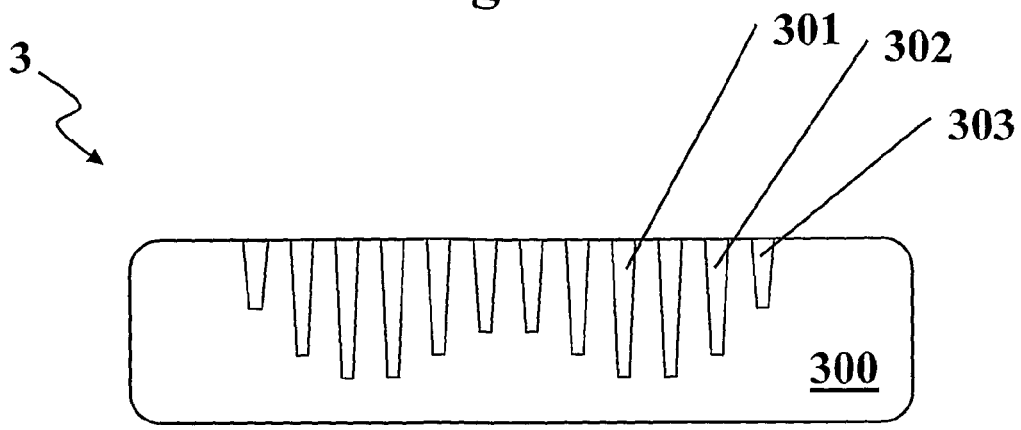
FIGS. 3A and 3B show alternative embodiments of the padding in FIGS. 1A and 1B.

In order to obtain good support and/or comfort, the pressure shape made by a person sitting in a seat is taken into account in a third embodiment. As shown in FIG. 3A, the depth of the recesses 301, 302 and 303 vary in order to obtain a softer or stiffer padding and support in the seat padding 3. By keeping the left and right side edge of the foam 300 massive, a harder support is provided here, while the collapsibility of the foam 300 around the recesses will vary according to how deep the recesses are. In this manner, the foam around the recesses 301 will collapse before the foam around the recesses 303. In this manner, the foam 300 obtains a varying softness with smooth transitions. As may be seen from FIG. 3A, the form is here adapted to the pattern of the buttocks of a person.

In addition to the smooth transitions in softness/stiffness, an expression of the padding which is not dependent on the technical padding effect may be achieved by the present invention. In FIG. 3A, the padding 3 for example, has a horizontal even expression, but technically the padding is softer in the right and left middle to front areas, and middle rear area, in the form of an inverted U-shape, because there are deep recesses in this area. The padding will be experienced as softer in these special areas, even if the impression of the cushion does not necessarily give this same impression. This solution may for example be used to hinder wrinkles in furniture covers, such as in exposed areas, so that the covers are stretched out when the furniture is not in use. The solution also provides possibility to use materials without any special stretching properties, such as thick leather, without having a sloppy look.

Figure 3B:
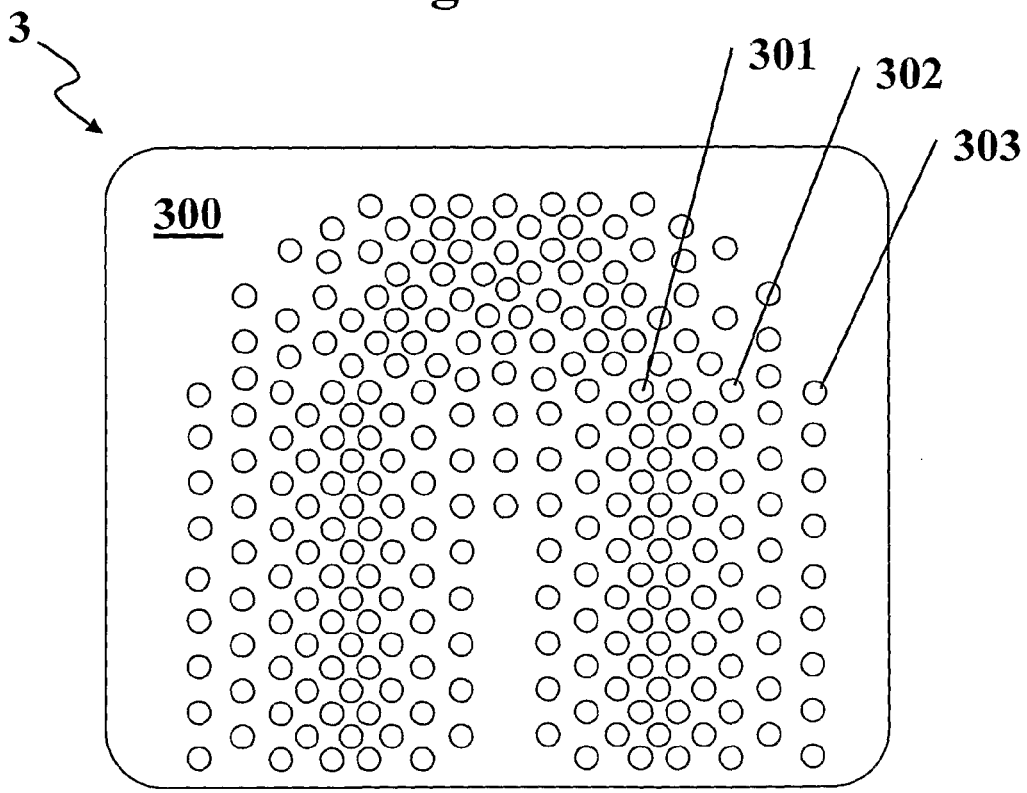

Adaptation of the recesses in relation to the softness and support of the padding 3 may also be performed by different distance between the recesses as shown in FIG. 3B, either exclusively or in addition to shape and/or depth of the recesses 301, 302 and 303. In FIG. 3B the padding 3 contains an increasing number of recesses per unit area in the seat area where the buttocks are in contact with the seat, something that will provide a comfortable and stable sitting feeling.

In this manner, the invention allows smooth transitions from firm to soft padding which has not been possible earlier by the use of the same foam. Further, firmness of a seat may be adapted during production by for example by a flexible mould which may be regulated in relation to the number of recesses and/or depth in order to adapt the product to the customer or marked.

By using the recesses in the foam a quicker flexibility in the foam is obtained in relation to massive foam, and further depending on the depth, the form and the circumference of the recesses in relation to other recesses.

Figure 4:
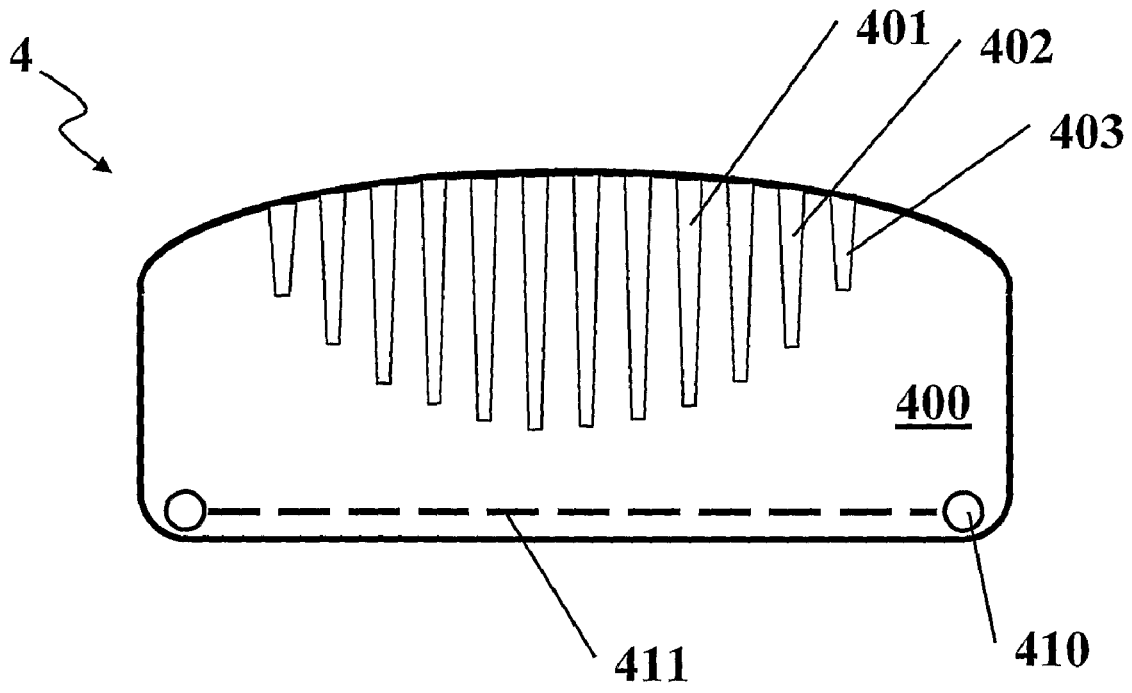
FIG. 4 shows an alternative padding with an integrated frame.

In addition to the smooth transition in softness/stiffness, an expression of the padding which is not dependent on the technical padding effect may be achieved by the present invention. In FIG. 4, the padding 4 has for example an upward curved expression, but technically the padding is softer in the middle than the outer edges because there are deeper recesses in this area. The padding will therefore be experienced as nice and soft, even if the impression of the cushion does not necessarily give this impression. This solution may for example be used to hinder wrinkles in a furniture cover 409, such as in exposed areas, so that the cover 409 is stretched out when the furniture is not in use. The solution also provides possibility for use of materials without any special stretching properties, such as thick leather, without having a sloppy look but tensioned out after use.

In FIG. 4 an embedded frame 410 is also shown, which may be a steel frame positioned in the outer edge of the padding 4, such as a rectangular closed frame. The frame 410 may comprise springs 411 extended between two parallel edges of the frame 410 to provide additional suspension in the cushion. Frames are more and more used in furniture, as an alternative to wooden supports. The frames may be produces in a production line and assembled in an automated manner. In addition frames may more easily be connected together by hinges or similar devices providing reclining functions in the final product, such as a chair or sofa, or even in beds.

Another advantage of the invention is that the recesses counteract fatigue in the foam part when moulded in the foam. The foam used, such as polyurethane foam, obtains an outer membrane during moulding which is stronger than the foam itself. This provides a stiffer surface which increases the strength. When the surface of the padding increases such as by an increase in the number of recesses, the strength is further increased, especially the tear strength and the resistance against deformation. Deformation may be caused by fatigue failure in the foam.

The movements which usually wear on the foam, by alternating compression and flexing back, become less critical, and thereby the technical lifetime of the padding is increased. The recesses only reach a certain depth, so that a solid base is always present in that none of the recesses go through the padding. In this manner the risk of tear is reduced as the solid base will always limit the sideways stretching of the padding, and absorbing heavy stresses.

As the collapsibility of the padding according to the present invention increases, that is, the deflection of the compression becomes larger than in normal foam padding, the interworking with the underlying springs in the furniture also increases when such springs are present, such as in a frame as described above. The user comes in closer contact with wave springs supporting the padding. Thereby the spring depth is increased as the springs are better put to use and a faster response time is achieved. The steel springs may be connected to a steel frame and be of the wave type springs.

The recesses in the foam also reduce the accumulation of humidity. Humidity is unfavourable for the foam because it reduces the strength and leads to collapse. Preferably a highly elastic foam is used, such as for example highly elastic polyurethane with melamine, or latex.

The invention may alternatively be performed by using passing holes in the foam, by the distribution and/or density and/or the form of the holes being different in order to obtain a smooth change in softness of the foam and also providing ventilation.

In an alternative embodiment the recesses or the holes may be filled completely or partly by foam of another quality, such as softer or harder foam in order to achieve similar effect, or completely other effects, such as increased support in certain areas enhanced by harder foam. One object for filling the recesses with soft foam may be to hinder that lint and dirt is gathered in the recesses.

The invention claimed is:

1. A method for producing padding for cushions, comprising:

adding a foam material to a cushion shaped mold, providing recesses in at least one portion of the foam extending depthwise from a top surface with different portions having different recess depths thereby providing varying softness by foam collapse, placing a frame in the mold with spaced apart frame members supporting wave springs therebetween opposite to the top surface, the wave springs opposing foam collapse of the cushion, forming the foam during molding in a manner whereby an outer membrane appears around the foam padding and inside the recesses and integral therewith, the membrane having a strength and stiffness greater than the foam within the membrane, thereby resisting permanent deformation and fatigue failure of the foam.

2. A method according to claim 1, further defined by varying the density, or depth, or shape of the recesses during production.

3. Padding for cushions for seating furniture, the padding comprising:

a molded foam cushion having a top surface with a plurality of depthwise recesses arranged at regions of expected greatest deflection, thereby providing softer padding in said regions;

a frame embedded at least partially within the molded foam cushion opposite to the top surface and having opposed edge members with wave springs therebetween opposite to the top surface and spaced apart from the depthwise recesses, the recesses permitting foam collapse toward the wave springs causing increased spring support action and fast cushion response against said collapse by the wave springs; and an outer membrane formed around the foam cushion and inside the recesses and being integral therewith, the membrane having a strength and stiffness greater than the foam within the membrane, thereby resisting permanent deformation and fatigue failure of the foam.

4. The padding according to claim 3, wherein the recesses taper towards the bottom thereof.

5. The padding according to claim 4, wherein the recesses have a cross-sectional form being any one of circular, oval, triangular, quadrangular or hexagonal.

6. The padding of claim 3 further defined by a cover fabric wherein the foam cushion has an upwardly curved top surface maintaining stretch against the cover fabric when the cushion is not in use.

7. The padding according to claim 6, wherein the recesses are slanted position in relation to the top surface of the foam cushion.

8. The padding according to claim 3, wherein the recesses are at least partly filled with foam of another hardness than the material of the foam cushion.

9. The padding according to claim 3, wherein the recesses are slanted position in relation to the top surface of the foam cushion.

10. The padding according to claim 3, wherein foam resilience increases with the depth of the recesses.

11. The padding according to claim 10, wherein increased resilience is in a U-formed area adapted to the buttocks of a user.

12. The padding of claim 3, wherein foam resilience increases with reduction in the spacing between recesses.

13. The padding according to claim 12, wherein increased resilience is in a U-formed area adapted to the buttocks of a user.

14. The padding according to claim 3 shaped for a seat cushion having a forward edge, wherein the forward edge of the cushion has increased resilience.

15. Padding for a seat comprising:

a molded foam cushion having a top surface with an array of depthwise recesses arranged with some deeper recesses inwardly of outer edges thereby providing softer padding in the inward region by foam collapse;

an outer membrane formed around the foam cushion and integral therewith, having a strength greater than the foam cushion within the membrane, thereby providing a stiffer surface than foam; and a frame at least partly embedded in the molded frame cushion and having parallel edge members disposed opposite to the upward surface with wave springs aligned therebetween and spaced apart from the depthwise recesses opposing foam collapse.

* * * * *